US006509842B1

(12) United States Patent
Kussel

(10) Patent No.: US 6,509,842 B1
(45) Date of Patent: Jan. 21, 2003

(54) CONTROL SYSTEM FOR A LONGWALL SUPPORT

(75) Inventor: Willy Kussel, Werne (DE)

(73) Assignee: Tiefenbach Bergbautechnik GmbH, Essen (DE)

( * ) Notice: Subject to any disclaimer, the term of this patent is extended or adjusted under 35 U.S.C. 154(b) by 0 days.

(21) Appl. No.: 09/550,326

(22) Filed: Apr. 14, 2000

(30) Foreign Application Priority Data

Apr. 16, 1999 (DE) ..... 199 17 112

(51) Int. Cl.[7] ..... G08C 17/00

(52) U.S. Cl. ..... 340/870.28; 299/1.05; 299/1.3

(58) Field of Search ..... 340/870.28; 299/1.05, 299/1.1, 1.6, 1.7, 1.3; 405/302; 702/9

(56) References Cited

U.S. PATENT DOCUMENTS

| | | | |
|---|---|---|---|
| 3,643,445 | A | 2/1972 | Schmidt |
| 4,228,508 | A | 10/1980 | Benthaus |
| 5,234,256 | A | 8/1993 | Demircan et al. |

FOREIGN PATENT DOCUMENTS

| | | | |
|---|---|---|---|
| DE | 23 03 433 | A | 8/1974 |
| DE | 31 14 305 | A1 | 11/1982 |
| DE | 42 02 246 | A1 | 8/1992 |
| DE | 195 46 427 | A1 | 8/1996 |
| GB | 2 254 640 | A | 10/1992 |
| GB | 2 265 652 | A | 10/1993 |

*Primary Examiner*—Timothy Edwards, Jr.
(74) *Attorney, Agent, or Firm*—Alston & Bird LLP

(57) ABSTRACT

A longwall control system controls a longwall support and facilitates the remote inspection of the longwall support. The longwall support comprises a plurality of hydraulically operated supports. The longwall control system comprises a plurality of shield control devices respectively associated with the supports for rearranging the supports in the sense of robbing, advancing, and setting. The longwall control system further comprises detection devices for detecting inspection values associated with the operating parameters of the shield control devices. The longwall control system also comprises a hand-operated device. The hand-operated devices comprises signaling devices, such as a readout or display. Long-distance transmission devices transmit the detected inspection values from the detection devices to the hand-operated device, and the signaling devices provide signals representative of the transmitted inspection values.

18 Claims, 3 Drawing Sheets

CONTROL SYSTEM FOR A LONGWALL SUPPORT

BACKGROUND OF THE INVENTION

The present invention relates to a control system for a longwall support having a plurality of hydraulically operated supports (mining shields).

A prior longwall control system of this general kind is disclosed in DE P 42 02 246.0 (Ti 9102) and U.S. Pat. No. 5,234,256, which are both incorporated herein by reference. In this prior case, the mining shields are adapted for automatic or manual rearrangement in the sense of robbing, advancing, and setting as a function of the position of the mining machine (cutters or plows).

This prior longwall control system has the disadvantage that its operation, be it for releasing functions, operational sequences or operating conditions, or be it for checking and observing the operability, exposes the operating person (operator) to safety risks. Likewise, the inspection of operability or operating conditions by one person is always subject to a risk of error, which is even intensified due to the difficult conditions in underground mining. This results again in hazards for a safe support of the longwall by incorrect readouts and wrong controls.

It is accordingly an object of the present invention to avoid these disadvantages and to equip the control system such that is operated free of wear and trouble, and yet is robust and reliable.

SUMMARY OF THE INVENTION

The present invention solves the above and other problems by providing a longwall control system for controlling a longwall support and facilitating the remote inspection of the longwall support. The longwall support comprises a plurality of hydraulically operated supports (mining shields), and a plurality of shield control devices respectively associated with the supports for rearranging the supports in the sense of robbing, advancing, and setting. The longwall control system further comprises detection devices for detecting inspection values associated with the operating parameters of the shield control devices. The longwall control system also comprises a hand-operated device. The hand-operated device comprises signaling devices, such as a readout or display. Long-distance transmission devices transmit the detected inspection values from the detection devices to the hand-operated device, and the signaling devices provide signals representative of the inspection values transmitted to the hand-operated device. This longwall control system has the advantage that it permits checking the operating parameters without requiring a hazardous closeness of the inspecting person to the longwall support that is to be inspected. A visual inspection of the operating parameters is no longer needed.

For further improving the operational safety, a control device for activating the shield control devices is integrated into the hand-operated device and connects to the shield control devices via a control radio network for releasing functions and operating conditions respectively.

For transmitting the inspection values, a radio network can be used or a long-range transmission by optical transmitters and sensors, in particular for infrared radiation, can be used. The latter possibility makes it unnecessary to use a further radio frequency and to reserve it for inspecting purposes.

To avoid influences on the control of functions and operating sequences by transmitting the inspection values, an interlock is utilized. More specifically, the control radio network (for releasing the functions and operating conditions respectively) and the long-distance transmission devices (for transmitting the inspection values) are interlocked so that the control radio network is disconnected by connecting the long-distance transmission devices, and the long-distance transmission devices are disconnected by connecting the control radio network.

In accordance with another aspect of the present invention, the hand-operated device comprises an operating side; a plurality of operating keys, which are mounted on the operating side, for the functions and operating conditions respectively; and an inspection side facing away from the operating side and mounting the signaling devices. This aspect prevents operating errors and makes it visually clear to the operator whether he is in the controlling or in the inspecting mode.

In accordance with another aspect of the present invention, the hand-operated device is equipped to meet with the special conditions of use in underground mining. More specifically, the long-distance transmission device is turned on and the control radio network is turned off only when the operator turns the hand-operated device toward him, and when in this process the light of the operator's head lamp falls on one or two diodes mounted on the inspection side of the hand-operated device.

In accordance with another safety-related aspect of the present invention, the long-distance transmission devices are blocked while light is simultaneously incident upon both of the diodes, and the long-distance transmission devices are connected and the control radio network is blocked while light is incident upon only one of the two diodes.

Another aspect of the present invention is operative so that it is not necessary for the operator of the hand-operated device to perform all steps of inspecting all elements of the longwall support. This aspect advantageously decreases the likelihood of the operator missing an inspection. To this end, the longwall control system recalls the individual inspection values according to a program, transmits them according to a predetermined sequence, and retransmits them to the individual signaling devices of the hand-operated device. The long-range transmission devices of the longwall control system comprise an associated transmitter, which is used for transmitting the inspection values of a plurality of detection devices and/or longwall supports. Likewise, in this instance, it is avoided that the correct and complete inspection of all functions or operating conditions that are to be inspected are left to the operator.

In accordance with another aspect of the present invention, each mining shield control device is associated to a transmitter, which connects to the detection devices of the longwall supports. The longwall control system is operative to ensure that before carrying out the controlling operations on a longwall support, the operator first performs the necessary and intended inspections thereof.

In accordance with another aspect of the present invention, the longwall control system is operative to ensure that an inspection relates to a certain longwall support. More specifically, the long-distance transmission devices are operative to be activated by a code that is unmistakably associated to the longwall support and can be generated and transmitted by means of the hand-operated device. Based on the applied code, the operator is able to determine whether a longwall support that is to be controlled has already been inspected.

BRIEF DESCRIPTION OF THE DRAWINGS

In the following, an embodiment of the invention is described in greater detail with reference to the drawings, in which.

DETAILED DESCRIPTION OF AN EMBODIMENT

Figure 1:
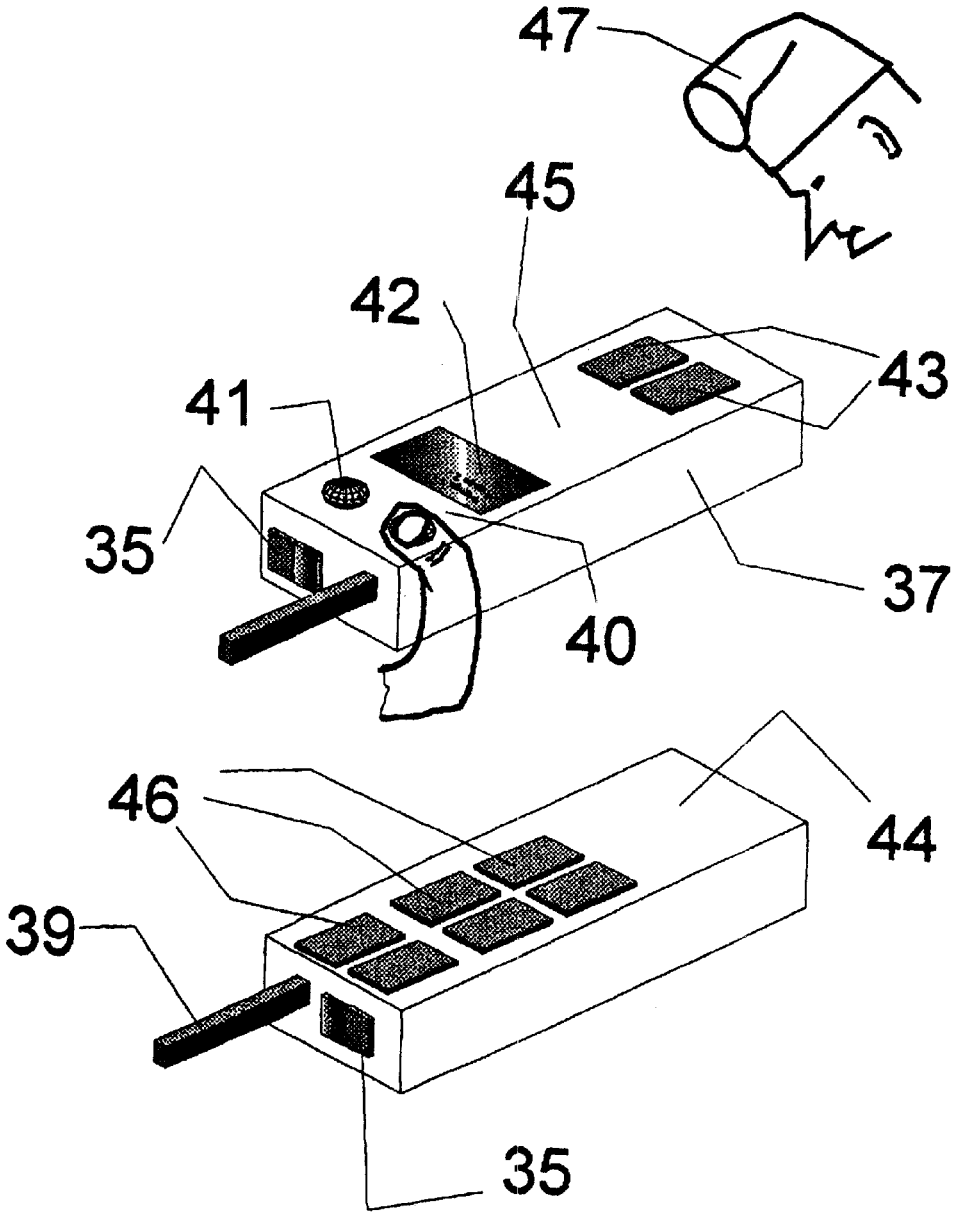
FIG. 1 illustrates a hand-operated device for controlling a longwall support, wherein the hand-operated device is shown in two positions.
Figure 2:
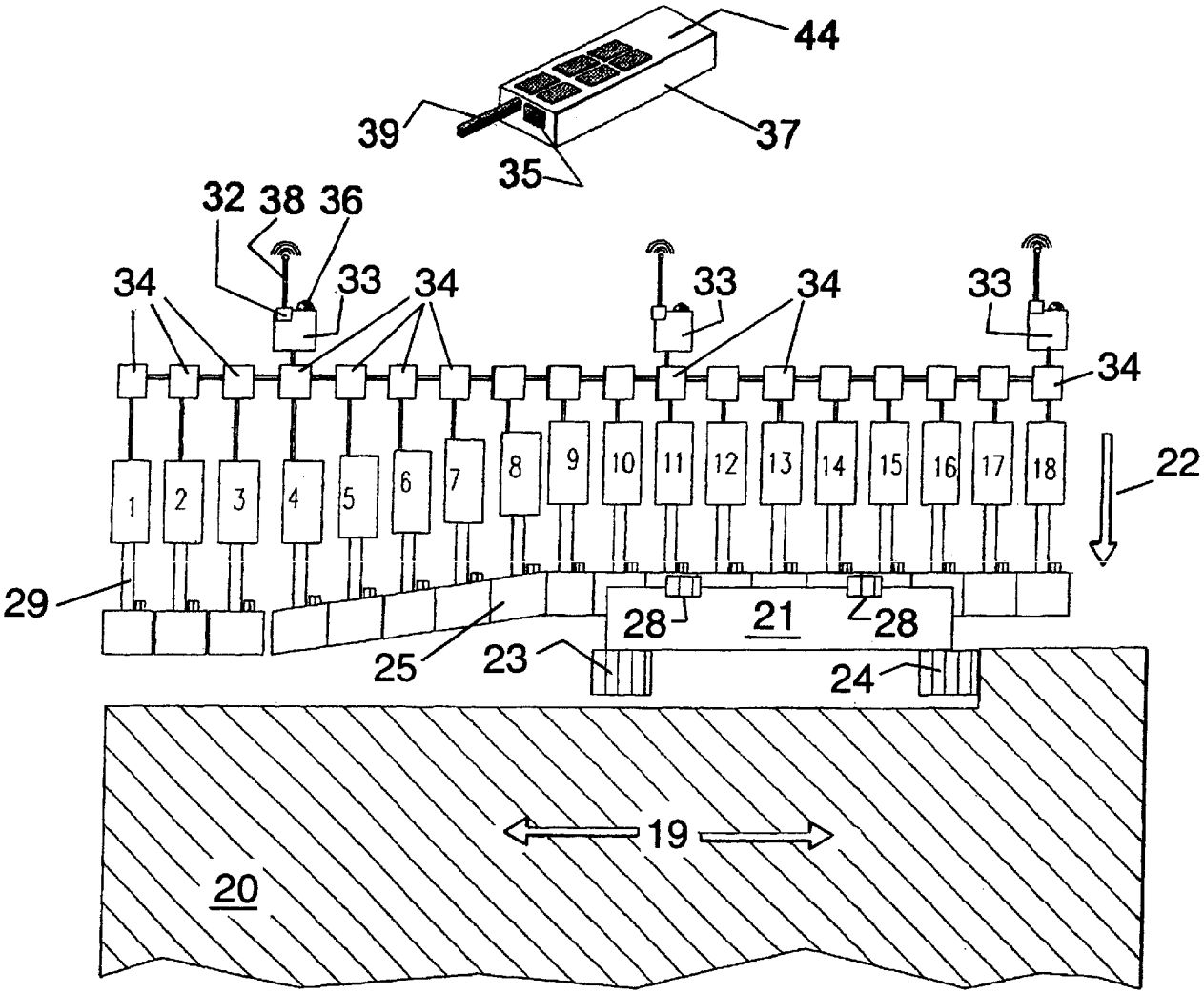
FIG. 2 is a schematic top view of a coal cutting machine.
Figure 3:
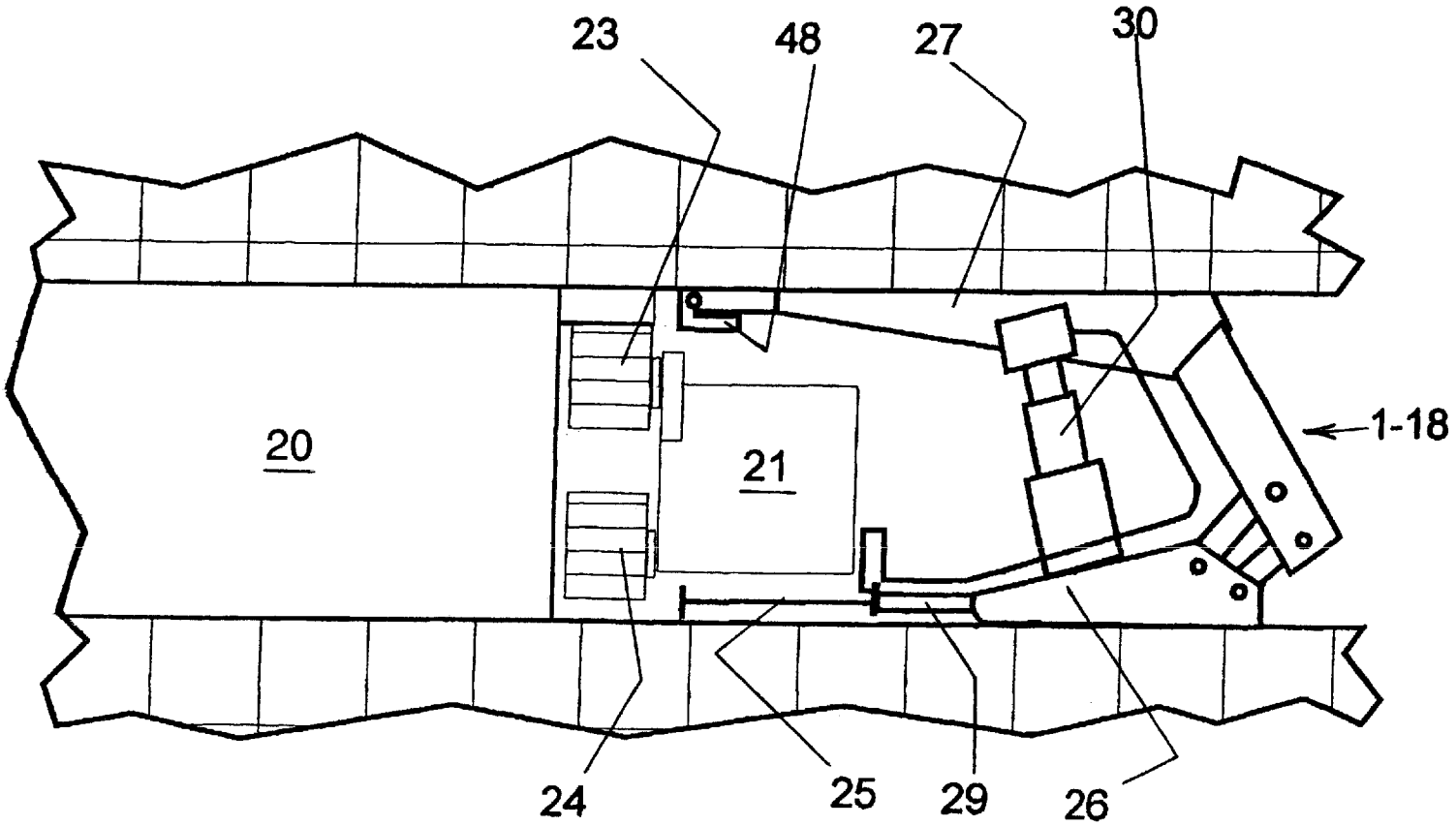
FIG. 3 is a sectional view of a longwall with a support.

FIG. 2 illustrates longwall support units 1–18. These support units are arranged along a coal bed 20. The coal bed 20 is mined in a working direction 22 with cutting devices 23, 24 of an extraction machine that is in the form of a coal cutting machine 21. The coal cutting machine 21 is movable in a cutting direction 19 by means of a cable (not shown). It possesses two cutting rolls 23, 24 that are adjusted to different heights, and shear the coal face. The dislodged coal is loaded by the coal cutting machine, also named "cutter-loader," on a conveyor 25. The conveyor 25 consists of a channel, in which an armored conveyor is moved along the coal face. The coal cutting machine 21 is adapted for moving along the coal face. The channel is subdivided into a plurality of individual units that are interconnected and are capable of performing a movement relative to one another in the working direction 22. Each of the units connects by means of a cylinder-piston unit (advance cylinder) 29 to one of the longwall support units 1–18. Each of the longwall support units serves the purpose of supporting the longwall. To this end, a further cylinder-piston 30 unit is used, which braces a base plate relative to a roof plate. At its front end facing the coal bed, the roof plate mounts a so-called coal face catcher 48. This catcher is a flap that can be lowered to the mined coal face. The coal face catcher must be raised ahead of the approaching coal cutting machine 21. Likewise to this end, a further cylinder-piston unit (not shown) is used.

In FIG. 2, the coal cutting machine moves to the right. For this reason, it is necessary that the coal face catcher of the longwall support 17 be folded back. On the other hand, the channel of longwall support 9, which is located behind the coal cutting machine 21, is advanced in the direction toward the mined coal face. Likewise, the following longwall supports 8, 7, 6, 5, and 4 are in the process of advancing in the direction toward the longwall or the mined coal face. The coal face catcher on these longwall support units has already been lowered again. The support units 3, 2, 1 have finished their approach and remain in this position, until the coal cutting machine approaches again from the right.

As a function of the movements of the coal cutting machine, the control of these movements occurs in part automatically, and in part manually. To this end, a separate mining shield control device 34 is associated to each longwall support, and longwall control devices 33 are separately associated with respective groups of longwall supports. Each of the mining shield control devices 34 connects to each longwall support unit. The mining shield control devices 34 also connect to one another. The automatic release of the functions and operating sequences is described, for example, in DE-A1 195 46 427.3. The manual operation involves the use of a control device 37, which is designed and constructed for manual operation and carried along by the operator. The hand-operated device connects by means of radio to radio receivers 38 of the longwall control device 33. The hand-operated device has the shape of a rectangular block and comprises operating keys on its one side (control side). With these keys, it is possible to input the code of each longwall support control that is to be operated, and to release a desired function or an operational sequence (for example, robbing or advancing). For a radio transmission, for example, an antenna 39 of the hand-operated device is used. When the operator rotates the hand-operated device about its longitudinal axis by 180°, he will see the control side of the device. This side comprises two diodes 40, 41, a display 42, as well as additional keys 43. With his head lamp 47, the operator is able to illuminate the two diodes. Only when he covers in this process the one of the diodes, for example 40, for example with a finger, will the checking function of the hand-operated device be started. For an inspection, the operator inputs the code of the longwall support that is to be inspected. As a result, the hand-operated device connects via an infrared transmitter/receiver 35 to a tuned infrared transmitter/receiver 36 on the longwall control device 33 that is addressed by the code. By means of one of the keys 43, it is now possible to recall certain functions or operating conditions. To this end, the longwall control system stores a program, which permits directing a sequence of inquiries concerning functions, operating conditions, and operating functions of a certain mining shield (longwall support) to the mining shield control that is addressed by codes, and performing same thereon. Subsequently, the received data are transmitted by means of the infrared transmitters/receivers 35, 36 to the hand-operated device, and shown on the display. In this manner, the operator is able to convince himself whether a certain longwall face support is still fully operable, or whether it requires maintenance or replacement of operating elements or control elements. This enables a reliable, troublefree and robust operation of the coal cutting machine and the longwall support, which requires little operating expenditure.

It has been found that even in underground mining, a reliable, troublefree radio transmission of the required position and direction signals is possible, and that even in the case of a significant longwall length, the longwall support control system can be reliably controlled via one of few radio receivers. To this end, the control device has the characteristic of retransmitting signals that are transmitted to one or individual control devices, to the others, and of enabling, via a common computer capacity, a reliable investigation of the longwall support units that are to be addressed respectively. As regards a technical realization, DE 195 46 427.3 is herewith incorporated by reference.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be is included within the scope of the appended claims. Although specific terms are employed herein, they are used in a generic and descriptive sense only and not for purposes of limitation.

That which is claimed:

1. A longwall control system for controlling and remotely inspecting a longwall support comprising a plurality of hydraulically operated supports, the longwall control system comprising:

a plurality of shield control devices respectively associated with the supports for rearranging the supports in the sense of robbing, advancing, and setting;

detection devices for detecting inspection values associated with the operating parameters of the shield control devices;

a hand-operated device comprising signaling devices;

long-distance transmission devices for transmitting the detected inspection values from the detection devices to the hand-operated device, wherein the signaling devices provide signals representative of the inspection values transmitted to the hand-operated device;

a control device for activating the shield control devices, wherein the control device is integrated into the hand-operated device and connects to the shield control devices via a control radio network for releasing functions and operating conditions respectively, wherein the control radio network and the long-distance transmission devices are interlocked so that the control radio network is disconnected by connecting the long-distance transmission devices, and the long-distance transmission devices are disconnected by connecting the control radio network.

2. A longwall control system according to claim 1, wherein the long-distance transmission devices are connected via a radio network having a different frequency than the control radio network.

3. A longwall control system according to claim 1, comprising a program operative for inquiring about and transmitting the inspection values according to a predetermined sequence, and retransmitting the inspection values to the signaling devices of the hand-operated device.

4. A longwall control system according to claim 1, wherein the long-distance transmission devices comprise a transmitter which connects to the detection devices.

5. A longwall control system according to claim 1, wherein the long-distance transmission devices comprise a transmitter associated to each of the shield control devices, wherein the transmitter connects to the detection devices.

6. A longwall control system according to claim 1, wherein the long-distance transmission devices are operative to be activated by a code that is unmistakably associated to the longwall support and can be generated and transmitted by means of the hand-operated device.

7. A longwall control system according to claim 1, wherein the long-distance transmission devices are connected by optical beams.

8. A longwall control system according to claim 7, wherein the long-distance transmission devices are connected by infrared radiation.

9. A longwall control system according to claim 1, wherein the hand-operated device comprises:

an operating side;

a plurality of operating keys, which are mounted on the operating side, for the functions and operating conditions respectively; and an inspection side facing away from the operating side and mounting the signaling devices.

10. A longwall control system according to claim 9, wherein the hand-operated device further comprises a light-sensitive diode that is on the inspection side and operative in response to incidence of light thereon to connect the long-distance transmission devices and disconnect the control radio network.

11. A longwall control system according to claim 9, wherein the hand-operated device further comprises first and second light-sensitive diodes that are on the inspection side, and the first and second a light-sensitive diodes are operative so that:

the long-distance transmission devices are blocked while light is simultaneously incident upon both the first and second light-sensitive diodes; and the long-distance transmission devices are connected and the control radio network is blocked while light is incident upon only one of the first and second light-sensitive diodes.

12. A longwall control system for controlling and remotely inspecting a longwall support comprising a plurality of hydraulically operated supports, the longwall control system comprising:

a plurality of shield control devices respectively associated with the supports for rearranging the supports in the sense of robbing, advancing, and setting;

detection devices for detecting inspection values associated with the operating parameters of the shield control devices;

a hand-operated device comprising signaling devices;

long-distance transmission devices for transmitting the detected inspection values from the detection devices to the hand-operated device, wherein the signaling devices provide signals representative of the inspection values transmitted to the hand-operated device; and a program operative for inquiring about and transmitting the inspection values according to a predetermined sequence, and retransmitting the inspection values to the signaling devices of the hand-operated device.

13. A longwall control system according to claim 12, wherein the long-distance transmission devices are operative to be activated by a code that is unmistakably associated to the longwall support and can be generated and transmitted by means of the hand-operated device.

14. A longwall control system according to claim 13, further comprising a control device for activating the shield control devices, wherein the control device is integrated into the hand-operated device and connects to the shield control devices via a control radio network for releasing functions and operating conditions respectively.

15. A longwall control system according to claim 14, wherein the control radio network and the long-distance transmission devices are interlocked so that the control radio network is disconnected by connecting the long-distance transmission devices, and the long-distance transmission devices are disconnected by connecting the control radio network.

16. A longwall control system according to claim 15, wherein the hand-operated device comprises:

an operating side;

a plurality of operating keys, which are mounted on the operating side, for the functions and operating conditions respectively; and an inspection side facing away from the operating side and mounting the signaling devices.

17. A longwall control system according to claim 16, wherein the hand-operated device further comprises first and second light-sensitive diodes that are on the inspection side, and the first and second a light-sensitive diodes are operative so that:

the long-distance transmission devices are blocked while light is simultaneously incident upon both the first and second light-sensitive diodes; and the long-distance transmission devices are connected and the control radio network is blocked while light is incident upon only one of the first and second light-sensitive diodes.

18. A longwall control system according to claim 16, wherein the hand-operated device further comprises a light-sensitive diode that is on the inspection side and operative in response to incidence of light thereon to connect the long-distance transmission devices and disconnect the control radio network.

* * * * *